US005505380A

United States Patent [19]

Jun

[11] Patent Number: 5,505,380

[45] Date of Patent: Apr. 9, 1996

[54] ANIMAL-PATTERNED SPRINKLING DEVICE

[75] Inventor: Mei-Be Jun, Changhua Hsien, Taiwan

[73] Assignee: Ting Yang Enterprise Co., Ltd., Taiwan

[21] Appl. No.: 305,360

[22] Filed: Sep. 13, 1994

[51] Int. Cl.[6] ..... B05B 3/06

[52] U.S. Cl. ..... 239/211; 239/251; 239/261

[58] Field of Search ..... 239/17, 19, 211, 239/251, 261, 273, DIG. 1, 12, 225.1, 264; 446/176, 179, 236; D23/201, 215, 217

[56] References Cited

U.S. PATENT DOCUMENTS

| | | | |
|---|---|---|---|
| D. 83,691 | 3/1931 | Mayerhofer | D23/215 |
| D. 164,770 | 10/1951 | Griswold | D23/215 |
| 181,614 | 8/1876 | Abbott | 239/251 X |
| 567,916 | 9/1896 | Newell | D23/217 X |
| 664,730 | 12/1900 | Dengler | 239/211 |
| 1,918,874 | 7/1933 | Shannahan | 239/211 X |
| 2,241,092 | 5/1941 | Jurgilanis | 239/211 X |
| 3,318,528 | 5/1967 | Williams | 239/17 |
| 3,448,928 | 6/1969 | Turner et al. | 239/251 |
| 3,610,532 | 10/1971 | Modrey | 239/251 |
| 4,205,785 | 6/1980 | Stanley | 239/211 X |
| 4,936,506 | 6/1990 | Ryan | 239/23 X |
| 5,261,603 | 11/1993 | Driska | 239/211 |
| 5,419,494 | 5/1995 | Harwood | 239/251 |

*Primary Examiner*—Andres Kashnikow
*Assistant Examiner*—Lesley D. Morris
*Attorney, Agent, or Firm*—Beveridge, DeGrandi, Weilacher & Young

[57] ABSTRACT

An animal-patterned sprinkling device includes a left and right animal-shaped housing halves, a water tube, several fitting washers, a fixing washer, upper and lower semispheric water discharging members and several sprinkling heads. At a top end and a bottom end of each of the animal-shaped housing halves are respectively formed two semicircular holes. Several posts and hollow cylindric columns are formed on inner faces of the left and right housing halves. The fitting washer and fixing washer are formed with rectangular teeth peripheries. The upper semispheric water discharging member has a central engaging tube which downwardly extends from a top end thereof. A lower end of the water discharging member is formed with four downward extending insertion plates. Four communicating tubes are disposed on a middle section of the engaging tube. Two eccentric stepped water discharging openings are formed at an upper end of the engaging tube. Two slanted water discharing passages are disposed on opposite inner walls of the water discharging openings. An eccentric stepped water discharging opening is formed at an outer end of each communicating tube. The lower water discharging member has four insertion recesses and an engaging tube which upwardly extends from a bottom end thereof for engaging with the engaging tube of the upper water discharging member.

15 Claims, 4 Drawing Sheets

ANIMAL-PATTERNED SPRINKLING DEVICE

BACKGROUND OF THE INVENTION

The present invention relates to an animal-patterned sprinkling device.

A conventional sprinkling device used in a garden is mostly designed with a monotonous cylindrical shape. When locating such sprinkling device in a garden or a sprinkling pool, the sprinkling device often fails to be compatible with the other scenes therein or even forms a defect of the appearance. Therefore, it is necessary to provide an improved sprinkling device with an attractive pattern to create a desired appearance.

SUMMARY OF THE INVENTION

It is a primary object of the present invention to provide an animal-patterned sprinkling device which can be located in a garden or a sprinkling pool to achieve an attractive appearance.

It is a further object of the present invention to provide the above sprinkling device in which the rushing force of the sprinkled water can make the semispheric water discharging members rotate to create various sprinkling patterns.

According to the above objects, the present sprinkling device includes left and right animal-shaped housing halves, a water tube, several fitting washers, a fixing washer, upper and lower semispheric water discharging members and several sprinkling heads. At a top end and a bottom end of each of the animal-shaped housing halves are respectively formed semicircular holes. Several posts and hollow cylindric columns are formed on inner faces of the left and right housing halves. The fitting washers and fixing washer are formed with rectangular teeth peripheries. The upper semispheric water discharging member has a central engaging tube which downwardly extends from a top end thereof. A lower end of the water discharging member is formed with four downwardly extending insertion plates. Four communicating tubes are disposed on a middle section of the engaging tube. Two eccentric stepped water discharging openings are formed at an upper end of the engaging tube. Two slanted water discharging passages are disposed on opposite inner walls of the water discharging openings. An eccentric stepped water discharging opening is formed at an outer end of each communicating tube. The lower water discharging member has four insertion recesses and an engaging tube which upwardly extends from a bottom end thereof for engaging with the engaging tube of the upper water discharging member. A sleeve member is used to fixedly connect the upper and lower semispheric members and the left and right housing halves together. The sprinkling heads are respectively connected in the stepped water discharging openings of the upper water discharging member to complete the assembly.

The present invention can be best understood through the following description and accompanying drawings, wherein:

DETAILED DESCRIPTION OF THE PREFERRED EMBODIMENT

Figure 1:
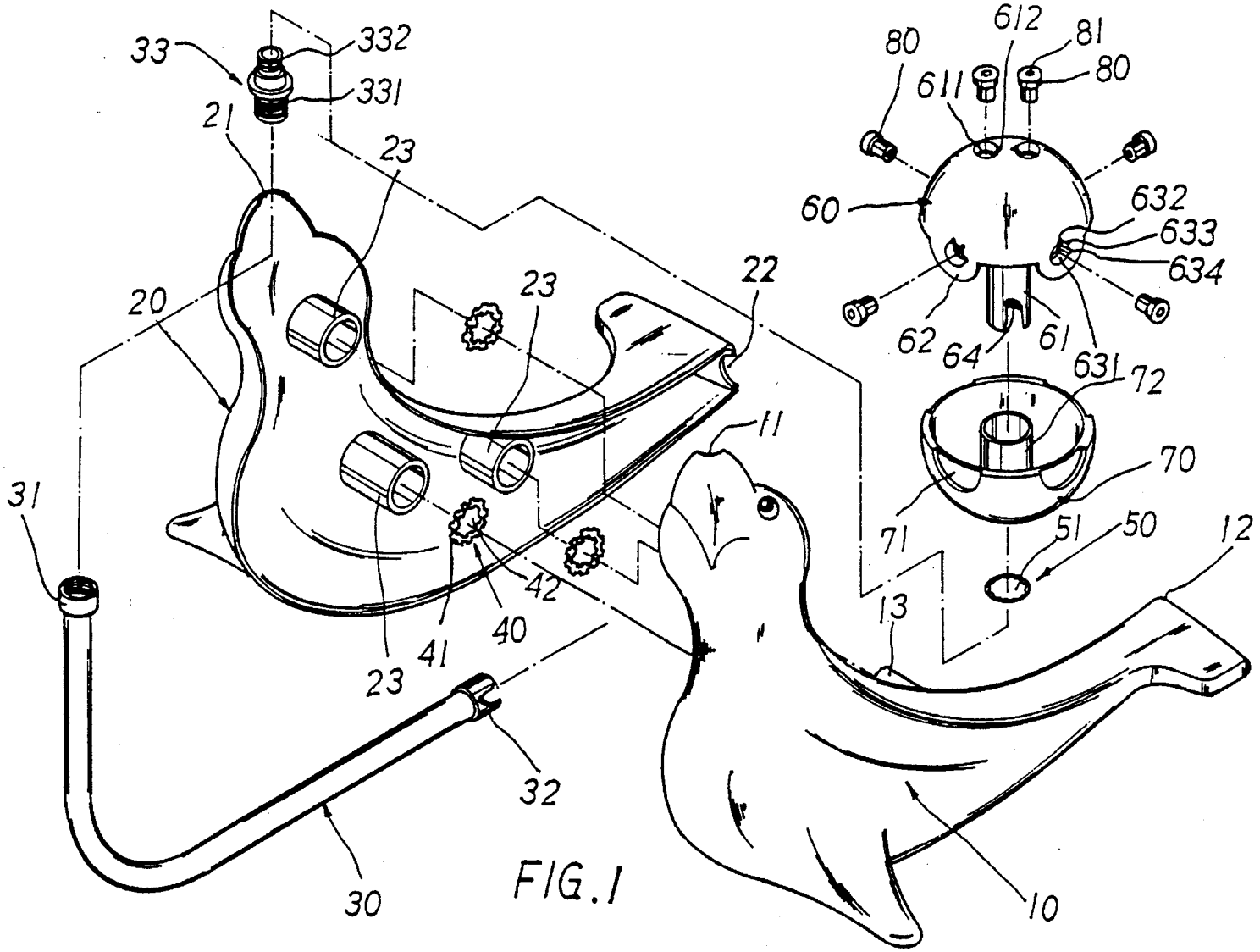
FIG. 1 is a perspective exploded view of the present invention.
Figure 2A:
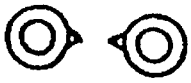
FIG. 2A is a top plane view showing the stepped water discharging openings and slanted water passages at the top of the upper semispheric water discharging member.
Figure 2B:
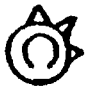
FIG. 2B is a side plane view showing the stepped water discharging opening and water passages at the outer end of the communicating tube of the upper semispheric water discharging member.
Figure 2:
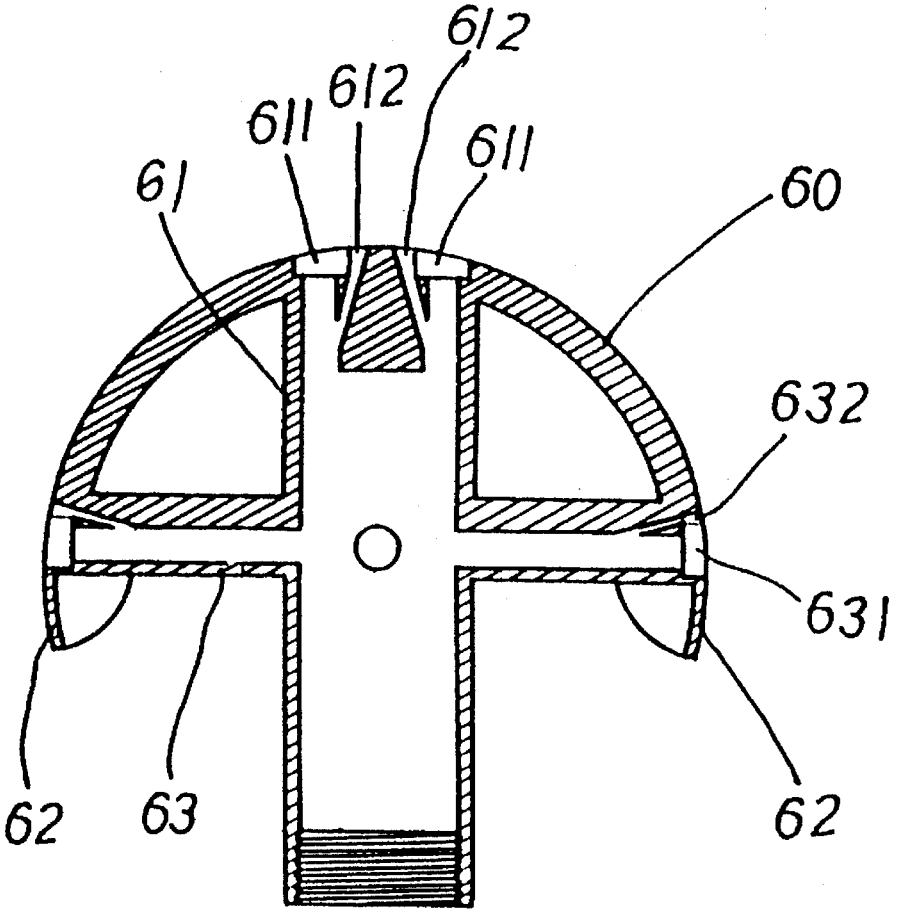
FIG. 2 is a sectional view of the upper semispheric water discharging member of the present invention.

Please refer to FIGS. 1 and 2. The present invention includes left and right animal-shaped housing halves 10, 20, a plastic water tube 30, a sleeve member 33, three fitting washers 40, a fixing washer 50, upper and lower semispheric water discharging members 60, 70, and six sprinkling heads 80. At a top end of each of the animal-shaped housing halves 10, 20 is formed a semicircular hole 11, 21. At a bottom end of each of the housings 10, 20 is formed a semicircular hole 12, 22. Several posts 13 are formed on an inner face of the left housing half 10 and several hollow cylindric columns 23 are formed on an inner face of the right housing half 20 corresponding to the posts 13. One end of the water tube 30 is disposed with a large diameter connector 31 formed with inner threads, and the other end thereof is disposed with a connector 32 formed with inner threads. The sleeve member 33 has an outer sleeve portion 331 and a connecting sleeve portion 332. The fitting washers 40 have a central hole 42 and are formed with rectangular teeth 41 on outer and inner peripheries. The fixing washer 50 has a central hole 51 and is formed with rectangular teeth on an inner periphery thereof. The upper semispheric water discharging member 60 has a central engaging tube 61 which downwardly extends from a top end of the water discharging member 60 and is formed with inner threads 64. A lower end of the water discharging member 60 is formed with four downwardly extending insertion plates 62 on front, rear, left and right sides. Four communicating tubes 63 are disposed on front, rear, left and right sides of a middle section of the engaging tube 61. Two eccentric stepped water discharging openings 611 are formed at an upper end of the engaging tube 61. Two slanted water discharging passages 612 are disposed on opposite inner walls of the water discharging openings 611. An eccentric stepped water discharging opening 631 is formed at an outer end of each communicating tube 63. A vertical, a 45 degree inclined and a horizontal water discharging passages 632, 633, 634 are disposed on a right upper side wall of the water discharging opening 631. Four insertion recesses 71 are formed on front, rear, left and right sides of an upper end of the lower semispheric water discharging member 70. The lower water discharging member 70 has an engaging outer tube 72 which upwardly extends from a bottom end of the water discharging member 70. The sprinkling heads 80 have a sprinkling mouth 81.

Figures 3, 3A:
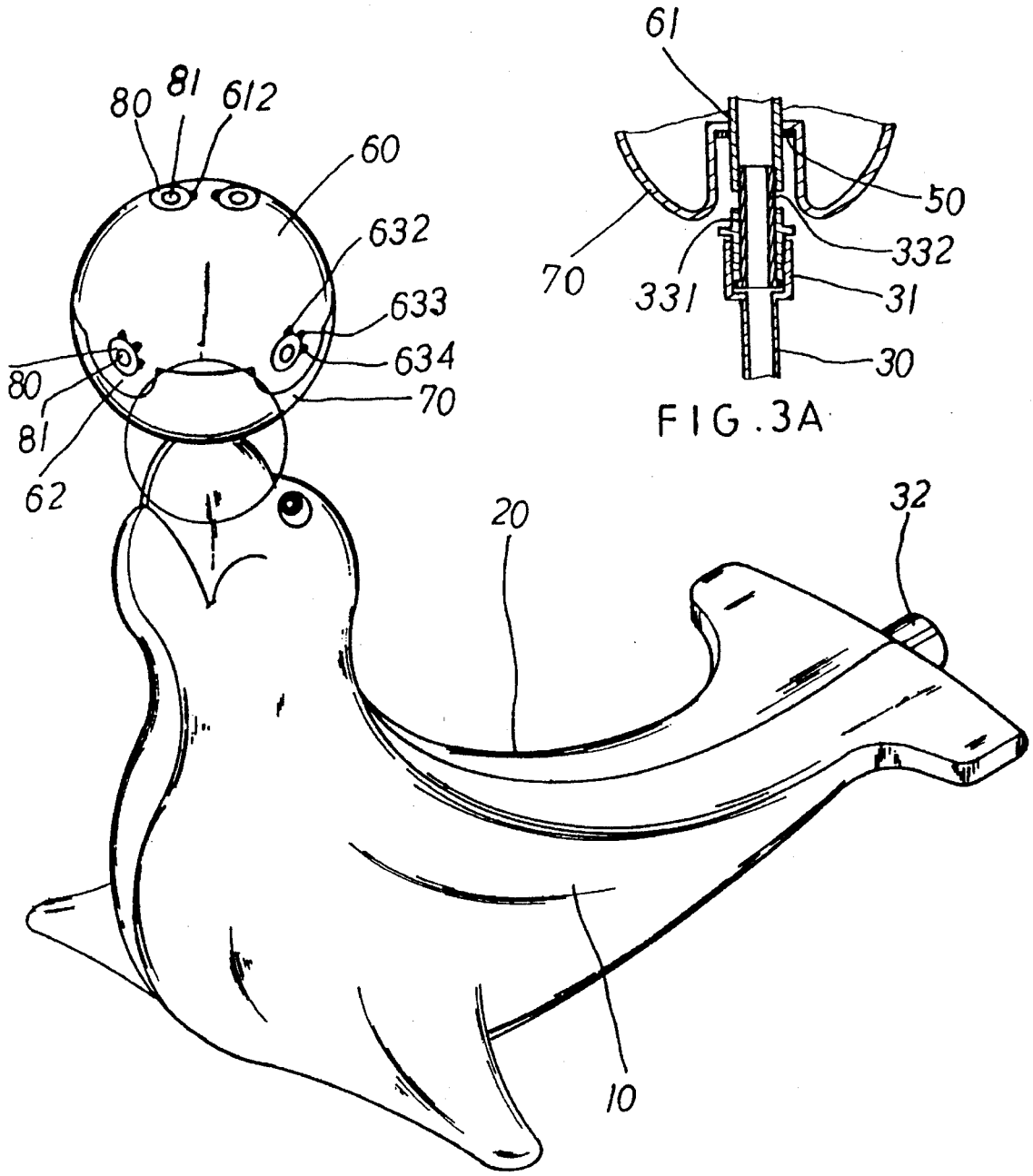
FIG. 3 is a perspective assembled view of the present invention.
FIG. 3A is a sectional view showing that the upper and lower semispheric water discharging members and the water tube are connected together by the sleeve member.

Please refer to FIGS. 3 and 3A. When assembled, the connector 31 of the water tube 30 is first placed in the semicircular hole 21 of the right housing half 20, and the connector 32 is placed in the semicircular hole 22 of the right housing half 20. The water tube 30 is located below the hollow cylindric columns 23 of the right housing half 20. The three fitting washers 40 are respectively fitted on the posts 13 of the left housing half 10 and then fitted into the columns 23 of the right housing half 20, with the rectangular teeth 41 tightly engaged with inner faces of the columns 23, whereby the left and right housing halves 10, 20 are fixedly associated with each other. A lower section of the engaging tube 61 of the upper water discharging member 60 is fitted with the outer engaging tube 72 of the lower water discharging member 70, and the insertion plates 62 of the upper water discharging member 60 are inserted into the insertion recesses 71 of the lower water discharging member 70. The fixing washer 50 is fitted on the engaging tube 61 and in the top end of the engaging tube 72 so as to fixedly associate the upper and lower water discharging members 60, 70 with each other. The connecting sleeve portion 332 of the sleeve member 33 is screwed into the inner thread 64 of the engaging tube 61, and the outer sleeve portion 331 of the sleeve member 33 is screwed into the inner thread of the connector 31 of the water tube 30 so as to fixedly connect the upper and lower semispheric members 60, 70 and the left and right housing halves 10, 20 together. Finally, the six sprinkling heads 80 are respectively connected in the stepped water discharging openings 611, 631 of the upper water discharging member 60 to complete the assembly.

Figure 4:
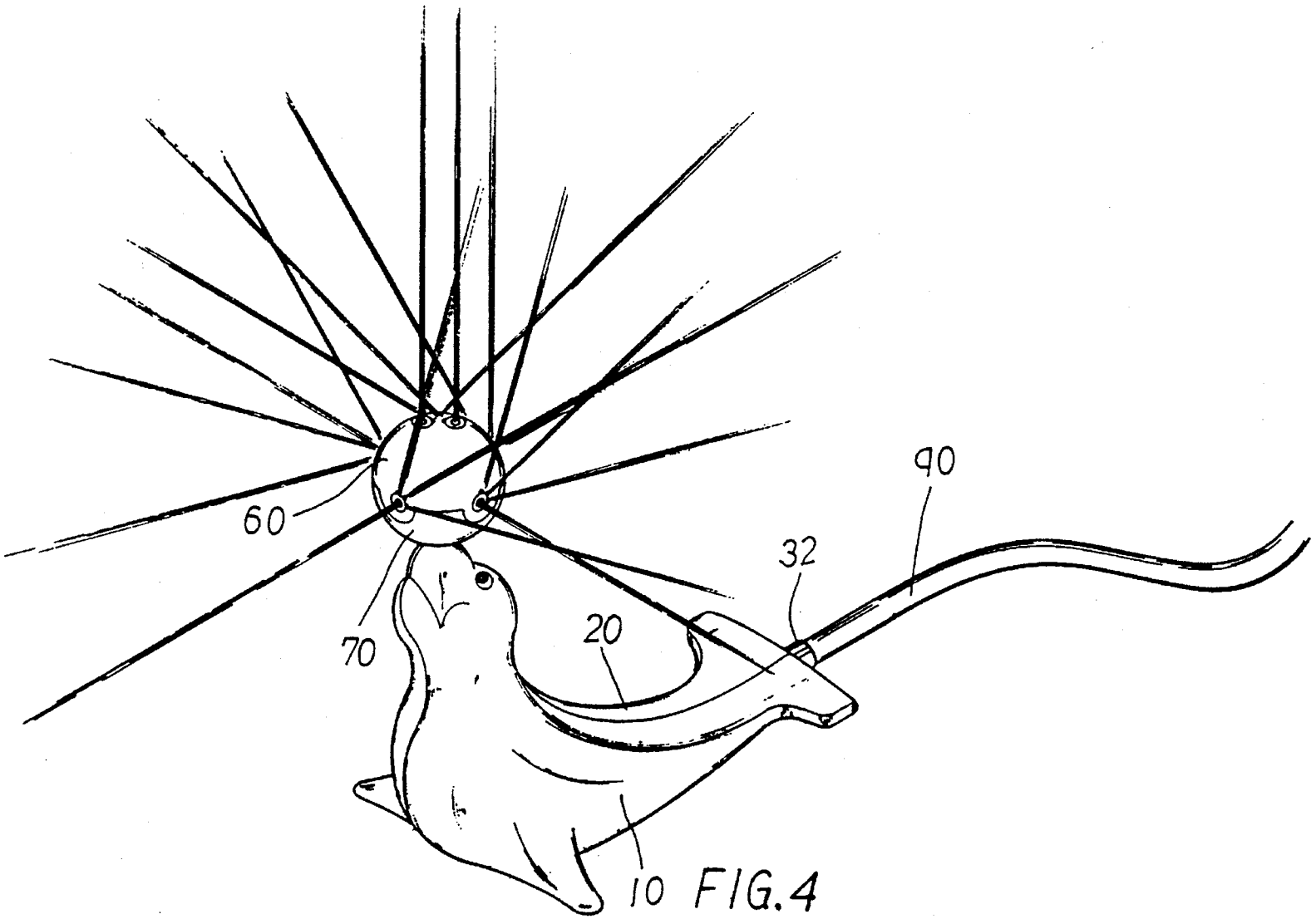
FIG. 4 shows that the water is sprinkled from the sprinkling device in various directions and patterns.

FIG. 4 shows that the connector 32 of the water tube 30 is connected with a water supplying tube 90 and the water flows through the water tube 30 and the connector 31 thereof and the sleeve member 33 into the engaging tube 61 of the upper water discharging member 60. The water then flows to the stepped water discharging openings 611 and the sprinkling mouths 81 of the sprinkling heads 80, as well as the slanted water passages 612, to be sprinkled outside. The water also flows to the stepped water discharging openings 631 of the four communicating tubes 63 to be sprinkled outside from the sprinkling mouths 81 of the sprinkling heads 80 and the water passages 632, 633 and 634.

According to the above arrangements, the animal-patterned sprinkling device can be located in a garden or a sprinkling pool to achieve a good appearance. In addition, the rushing force of the sprinkled water can make the semispheric water discharging members rotate to create various sprinkling patterns.

The above embodiment is only an example of the present invention and the scope of the present invention should not be limited to the example. Any modification or variation derived from the example should fall within the scope of the present invention.

What is claimed is:

1. An animal-patterned sprinkling device comprising:

left and right animal-shaped housing halves, a water tube housed in the left and right housing halves, a sleeve member connected to a first end of the water tube, a plurality of fitting washers for connecting the left and right housing halves, upper and lower semispheric water discharging members engaged with the water tube via the sleeve member, and a plurality of sprinkling heads provided in the upper semispheric water discharging member, wherein a semicircular hole is defined at a top end of each of the animal-shaped housing halves, and a semicircular hole is defined at a bottom end of each of the animal-shaped housing halves, wherein a plurality of posts are formed on an inner face of the left housing half, and a plurality of hollow cylindric columns are formed on an inner face of the right housing half, such that a hollow cylindric column is formed at a position corresponding to each of the posts;

wherein one end of the water tube includes a connector formed with an inner thread, and the other end of the water tube includes a connector formed with an inner thread;

wherein the sleeve member has an outer sleeve portion and a connecting sleeve portion;

wherein each fitting washer has a central hole and is formed with rectangular teeth on outer and inner peripheries thereof;

wherein the upper and lower semispheric water discharging members are connected together at a fixing washer, wherein the fixing washer has a central hole and is formed with rectangular teeth on an inner periphery thereof;

wherein the upper semispheric water discharging member has a central engaging tube which extends downwardly from a top end of the upper semispheric water discharging member and is formed with an inner thread, wherein a lower end of the upper semispheric water discharging member is formed with four downwardly extending insertion plates on front, rear, left and right sides, wherein four communicating tubes are disposed on front, rear, left and right sides of a middle section of the central engaging tube, wherein first and second eccentric stepped water discharging openings are formed at an upper end of the central engaging tube, wherein two slant water discharging passages are disposed on opposite inner walls of the first and second water discharging openings, wherein a third eccentric stepped water discharging opening is formed at an outer end of each communicating tube, wherein vertical, inclined and horizontal water discharging passages are disposed on a right upper side wall of the third water discharging opening;

wherein an upper end of the lower semispheric water discharging member is formed with four insertion recesses on front, rear, left and right sides for engaging the four insertion plates of the upper semispheric water discharging member, wherein the lower semispheric water discharging member has an engaging outer tube which extends upwardly from a bottom end of the lower semispheric water discharging member to receive the central engaging tube of the upper semispheric water discharging member; and wherein each sprinkling head has a sprinkling mouth.

2. A sprinkling device, comprising:

a first housing half, wherein a hole is defined in each of a first end and a second end of the first housing half, and wherein a plurality of posts are formed on an inner face of the first housing half;

a second housing half connected to the first housing half, wherein a hole is defined in each of a first end and a second end of the second housing half, and wherein a plurality of hollow cylindric columns are formed on an inner face of the second housing half, such that one hollow cylindric column is formed at a position corresponding to each of the posts of the first housing half;

a water tube housed in the first housing half and the second housing half, wherein a first end of the water tube includes a connector, and a second end of the water tube includes a connector;

a sleeve member connected to a first end of the water tube;

a first water discharging member, wherein a first end of the first water discharging member has insertion recesses defined therein, and wherein the first water discharging member has an outer engaging tube which extends from a second end of the first water discharging member;

a second water discharging member connected to the first water discharging member, wherein the second water discharging member has an engaging tube which extends from an inner surface of the second water discharging member for extending into the outer engaging tube of the first water discharging member, and wherein an end of the second water discharging member has insertion plates for extending into the insertion recesses of the first water discharging member, wherein the first and second water discharging members are engaged with the water tube via the sleeve member; and a plurality of sprinkling heads provided in the second water discharging member.

3. A sprinkling device according to claim 2, wherein each sprinkling head has a sprinkling mouth.

4. A sprinkling device according to claim 2, wherein the cylindric columns of the second housing half are connected to the respective posts of the first housing half by a fitting washer.

5. A sprinkling device according to claim 4, wherein the fitting washer has a central hole, and the central hole has teeth formed on outer and inner peripheries thereof.

6. A sprinkling device according to claim 2, wherein the first water discharging member is connected to the engaging tube of the second water discharging member by a fixing washer.

7. A sprinkling device according to claim 6, wherein the fixing washer has a central hole, and the central hole has teeth on an inner periphery thereof.

8. A sprinkling device according to claim 2, further including a plurality of communicating tubes disposed on a middle section of the engaging tube of the second water discharging member.

9. A sprinkling device according to claim 8, wherein four communicating tubes are provided such that one communicating tube is provided on each of the front, rear, left and right sides of the middle section of the engaging tube of the second water discharging member.

10. A sprinkling device according to claim 9, wherein an eccentric stepped water discharging opening is formed at an outer end of each communicating tube.

11. A sprinkling device according to claim 2, wherein water discharging openings are formed at an end of the engaging tube of the second water discharging member.

12. A sprinkling device according to claim 11, wherein two slant water discharging passages are disposed on opposite inner walls of the water discharging openings.

13. A sprinkling device according to claim 2, wherein four insertion plates are provided on the second water discharging member, and four insertion recesses are defined in the first water discharging member.

14. A sprinkling device according to claim 2, wherein the sleeve member has an outer sleeve portion and a connecting sleeve portion.

15. A sprinkling device according to claim 2, wherein the sleeve member connects directly to the engaging tube of the second water discharging member.

* * * * *